US007740561B2

(12) United States Patent
Kupferman

(10) Patent No.: US 7,740,561 B2
(45) Date of Patent: Jun. 22, 2010

(54) HAND EXERCISING DEVICE

(76) Inventor: Scott Kupferman, 6 Butternut Ct., Dix Hills, NY (US) 11746

( * ) Notice: Subject to any disclaimer, the term of this patent is extended or adjusted under 35 U.S.C. 154(b) by 0 days.

(21) Appl. No.: 11/477,196

(22) Filed: Jun. 27, 2006

(65) Prior Publication Data

US 2006/0247102 A1 Nov. 2, 2006

Related U.S. Application Data

(63) Continuation-in-part of application No. 10/419,359, filed on Apr. 21, 2003, now abandoned.

(51) Int. Cl.
*A63B 23/16* (2006.01)

(52) U.S. Cl. ..... 482/47; 482/148

(58) Field of Classification Search ..... 482/44, 482/47–48, 121–124; 601/40
See application file for complete search history.

(56) References Cited

U.S. PATENT DOCUMENTS 2,108,236 A * 2/1938 Scott ..... 482/48
2,222,180 A * 11/1940 Marsh ..... 84/468
4,875,469 A * 10/1989 Brook et al. ..... 601/40
5,514,052 A * 5/1996 Charles et al. ..... 482/47
6,146,341 A * 11/2000 Sato et al. ..... 601/23
2003/0073939 A1* 4/2003 Taylor et al. ..... 601/40
2003/0162634 A1* 8/2003 Farrell et al. ..... 482/47

* cited by examiner

*Primary Examiner*—Fenn C Mathew
(74) *Attorney, Agent, or Firm*—Handal & Morofsky, LLC; Anthony H. Handal

(57) ABSTRACT

An exercising device for the hand is disclosed. A securement is secured to an anchoring member comprising a band with a pair of ends configured to extend around and be secured to the hand of the user and configured to support the anchoring member in a position overlying the palm of the hand of a user and is coupled to the hand of the user. A plurality of fingertip engaging members are each configured and dimensioned to be secured to a respective fingertip a plurality of fingertip anchorings. Each of the fingertip anchorings is secured to a respective fingertip engaging member. A plurality of respective palm anchorings are secured to the anchoring member. A plurality of respective elastic members each have first and second ends. The first end of each of the elastic members is secured to the fingertip anchorings. The second end of each of the elastic members is secured to the palm anchorings. Alternatively, the securement and the anchoring member comprise a closed loop elastic strap.

2 Claims, 11 Drawing Sheets

13

13

HAND EXERCISING DEVICE

CROSS REFERENCE TO RELATED PATENT APPLICATIONS

This application is a continuation in part of U.S. patent application Ser. No. 10/419,359, filed on Apr. 21, 2003 now abandoned and entitled HAND EXERCISING DEVICE.

TECHNICAL FIELD

The present invention relates to exercise devices and, more particularly, to devices for strengthening or rehabilitating the extensor muscles and other muscles involved with the movement of the joints in the hands, wrist, fingers and thumb.

STATEMENT REGARDING FEDERALLY SPONSORED RESEARCH OR DEVELOPMENT (Not Applicable)

BACKGROUND OF THE INVENTION

It has long been recognized that it is possible to strengthen the muscles and tendons of a human hand by providing resistive exercises over a period of time. It has been found especially desirable to provide a device which offers adjustable resistance to the fingers, wrists and forearms being flexed in order to provide a suitable degree of exercise to the joints in motion. In the instance of post traumatic recovery, it is important to provide increasing resistance during the period when the muscles and tendons of the hand, wrist and forearms are recovering from the injury. Finger and wrist exercisers have also been suggested which would provide conditioning for a healthy hand, such a device being used by dentists, athletes or other persons requiring a high degree of manual dexterity and strength in their professions.

Moreover, a proliferation of computer keyboards in offices and homes has given rise to a dramatic increase in repetitive strain injuries such as nerve entrapments, tendon problems and muscle strain. Such injuries are commonly perceived as persistent aches or soreness in the forearms and wrists, or pain that may be felt from the shoulder to the fingertips. If left untreated, the soreness can escalate into a full blown disability.

One of the numerous types of repetitive strain injury is known as carpal tunnel syndrome. This refers to compression of the median nerve as a result of swelling of tendons and sheaths, or repeated bending of the wrist, as can occur in susceptible individuals as a result of protracted use of a computer keyboard. The position in which the hands and fingers are placed to use a keyboard typically keeps the associated muscles in flexion which may cause the carpal dome to slip in an anterior direction, causing shooting pain and numbness in the fingers. Wrist rests and other devices are commonly used to support the wrists when there is a pause during typing. However, such devices, while relieving stress on muscles and joints in some circumstances, do nothing to strengthen or rehabilitate the muscles and joints to avoid injury, or to rehabilitate from prior injury. Moreover, the advantageous aspects of wrist rests may depend on the manner in which the user's wrist is positioned. Misuse of a wrist rest may in fact cause more harm than good, increasing the potential for carpal tunnel injury.

Charles et al., U.S. Pat. No. 5,514,052 describes a "finger exerciser" which suffers from the disability of not providing a force against which to exercise the thumb because it uses an elbow anchor. The patent discloses a device for carpal tunnel syndrome having "a plurality of elastic bands" extending from a housing attached at the elbow and extending to the wrist and projecting on the inside of the wearer's palm and attached to the tips of each finger. The device is designed to exercise the extensor muscles of the hand, wrist, and fingers by having the digits extend outwardly working against the tension of the elastic bands.

Fasano, U.S. Pat. No. 3,944,220 teaches a glove which is a hand exerciser. It also fails to show a structure which is substantially stretched by the thumb, as anchoring is at the wrist. The patent describes a glove having flexible inserts radiating from the wrist to the tip of each finger embedded into the palm surface. The inserts may be tightened at the wrist to adjust the tension. However, it is difficult to see how such a device can be put on the hand without great difficulty, with fingers curled up by the elastic straps.

Harris, U.S. Pat. No. 4,455,019 discloses an exerciser for finger, hand, wrist and forearm. The exerciser consists of a frame with a hand support, a system of pulleys and weights, and finger-receiving loops. The user would insert the fingers into the loops and either extend the fingers without moving the wrist or flex the wrist backwards.

Although there are many devices in the prior art for exercising the fingers, these prior devices do a poor job of fully exercising the hand muscles. The prior art exercises for extension and flexion do not provide balanced finger extension exercise in that they are largely unable to move the thumb in its natural flexion path. More specifically, exercise devices, such as spongy balls for squeezing, coil springs and the like, and normal exercise tend to emphasize development of the muscles which close the hand into a fist. The result is that the natural position of the hand is with the fingers curled inwards. This means that the muscles are relatively short in their relaxed state and the grip of the hand is weak; loss of range of motion becomes an issue after a time. This is a natural result of aging in all people, for example exhibited as a slow closing of the hand accelerated more so at the ring and pinky fingers.

In order to strengthen the muscles and joints of the hand to avoid carpal tunnel injury or repetitive strain injuries (RSI), it is desirable to strengthen the extensor muscles and tendons to prevent those muscles from becoming overpowered by flexor muscles as well as becoming injured by repetitive strain. While various devices have been proposed which exercise the extensor muscles, such devices are inadequate due to poor design to address the causes of repetitive strain injuries There is accordingly a need for a device which can provide these desirable capabilities to specifically address the conditioning of the thumb, fingers, wrists and forearms leading to the elbows by exercise in a natural path of motion.

SUMMARY OF THE INVENTION

An exercising device for the hand, wrist and forearm comprises an anchoring member. A securement is secured to the anchoring member comprising a band with a pair of ends configured to extend around and be secured to the hand of the user and configured to support the anchoring member in a position overlying the palm of the hand of a user and is coupled to the hand of the user. A plurality of fingertip engaging members are each configured and dimensioned to be secured to a respective fingertip a plurality of fingertip anchorings. Each of the fingertip anchorings is secured to a respective fingertip engaging member. A plurality of respective palm anchorings are configured on the anchoring member. A plurality of respective elastic members each have first and second ends. The first end of each of the elastic members is secured to the fingertip anchorings. The second end of each of the elastic members is secured to the palm anchorings.

Alternatively, the securement and the anchoring member comprises a closed loop elastic strap.

Alternatively, elastic members may be removably attached at the palm and at the fingertips. This allows the substitution of selected elastic members requiring greater or lesser force. Such selection is made depending on the strength of the hand and other exercise objectives.

In accordance with the preferred embodiment, the securement and the anchoring member comprise a strap with a pair of ends. The ends are oriented and dimensioned to extend around the hand and palm of a user. A first mating attachment is attached to one of the straps. A second mating attachment is attached to the other of the straps. The first mating attachment is attachable to the second mating attachment to secure the straps around the hand of a user. In accordance with the preferred embodiment, the ends may be secured to each other by Velcro or the ends may be secured to each other by a buckle. Alternatively, the ends may be secured to each other by a stud on one end which mates with holes on the other end.

The inventive device may be used in therapy in the case of a hand where range of motion has been compromised or as a conditioning device to build strength, combat the effects of aging and minimize the risk of injury.

In accordance with an alternative embodiment, the elastic members may be secured to any one of a number of palm anchorings.

In accordance with one embodiment, the fingertip engaging members and the anchoring members are injection molded in one operation, with the elastic members integral with the anchoring member.

In accordance with the invention, the elastic members may comprise elastic rubber. Likewise, the cups may be made of elastic rubber.

In accordance with an alternative embodiment the elastic members may be permanently secured to fingertip anchorings and the palm anchorings may be disposed throughout the area of the anchoring member which overlies the palm of a user when the exercising device is used. The palm anchorings may be removably connected to the second ends of the elastic members, in order to provide customization of the force and direction of force experienced by the hand during exercise.

The preferred embodiment of the apparatus of the present invention provides a device for exercising the finger, thumb, hand, wrist and forearm, thereby providing a useful therapeutic device for persons recovering from traumatic injury to the hand and its associated anatomic parts. The present device is also useful for athletes, musicians, surgeons, typists and other persons requiring a high degree of manual dexterity in their professions.

Still another embodiment of the invention uses a palm rest on a base to which a plurality of elastic members are secured to provide a convenient desk exercise device.

BRIEF DESCRIPTION OF THE DRAWINGS

Some embodiments of the invention, and of making and using the invention, as well as the best mode contemplated of carrying out the invention, if not described above, are described in detail below, by way of example, with reference to the accompanying drawings, in which like reference characters where practical designate the same or similar elements throughout the several views, and in which.

DETAILED DESCRIPTION OF THE INVENTION

Figure 5:
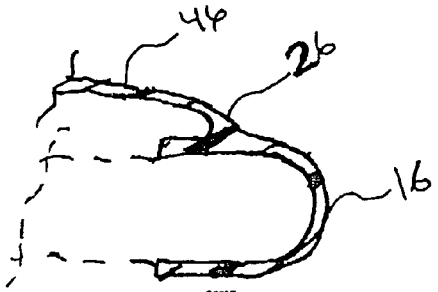
FIG. 5 illustrates an anchoring in accordance with the invention along lines 5-5 of FIG. 1.

The detailed description set forth below in connection with the appended drawings is intended as a description of the presently preferred embodiment of the invention, and is not intended to represent the only form in which the present invention may be constructed or utilized. The description sets forth the functions and sequence of steps of constructing and operating the invention in connection with the illustrated embodiments. It is understood, however, that the same or equivalent functions and sequences may be accomplished by different embodiments that are also intended to be encompassed within the spirit and scope of the invention.

Referring to FIGS. 1-5, the inventive hand exerciser 5 comprises a belt-like anchoring member 10. In accordance with the preferred embodiment, hand exercisers are provided in a number of discrete sizes, such as a size dimensioned for a relatively small child, perhaps the average sized 10-year-old. The next size up may match the average 15-year-old, followed by an exerciser whose size is matched to the size of an average 22-year-old. Perhaps two larger sizes may be provided for individuals with still larger hands and those whose hands are exceptionally large.

In preferred embodiments, anchoring member 10 is a substantially planar member made of a flexible material and long enough to extend around the palm and back of the hand of the user with enough extra lengths to allow use of a suitable fastener. Suitable materials for anchoring member 10 may include any strong flexible material such as plastic or textile fabric, preferably of relatively thick dimension and not necessarily flat or one-dimensional.

Engagement of the fingertips of the hand with hand exerciser 5 is achieved through the use of five fingertip engaging members. In accordance with the preferred embodiment, the fingertip engaging members take the form of a plurality of flexible cups 12-20. Thumb cup 12 is of relatively large dimension to accommodate the thumb. In accordance with the preferred embodiment, thumb cup 12 is made slightly larger than the thumb of the hand of the size for which the hand exerciser 5 is designed. This allows it to be easily positioned over the tip of the finger in preparation for exercise as detailed below.

Thumb cup 12 must also be relatively strong because proper exercising of the thumb requires more force than, for example, proper exercising of the pinkie. Accordingly, thumb cup 12 is subjected to greater forces and must be dimensioned to remain durable under constant forces of the magnitude needed to properly exercise the thumb.

Forefinger cup 14, in accordance with the preferred embodiment, is thinner than thumb cup 12. However, cups 12-20 may all be the same dimension, or a limited number of dimensions, which will reduce costs in the case of an exercising device constructed in accordance with the present invention made from separately molded cups connected by separate non-integral elastic members, as all be described more fully below.

Middle finger cup 16 and ring finger cup 18 are also of somewhat smaller dimension, in accordance with the preferred embodiment, as compared to thumb cup 12. However, pinkie cup 20, which fits around the pinkie fingertip is of still smaller dimension because the pinkie is the smallest finger on the hand. Thus, each of cups 12-20 is configured and dimensioned to be loosely fit onto and secured to its respective fingertip.

Each of the cups 12-20 is, in accordance with the preferred embodiment, formed integrally with a respective one of fingertip anchorings 22, 24, 26, 28, and 30. Anchoring 26, for illustrative purposes, is shown in detail in FIG. 5 and generally comprises a wide conical base portion 31. An opposite tension point to fingertip anchorings 22-30 is provided by five palm anchorings 32, 34, 36, 38, and 40, respectively. Palm anchorings 32, 34, 36, 38, and 40 are secured at their respective positions on anchoring member 10.

Figure 1:
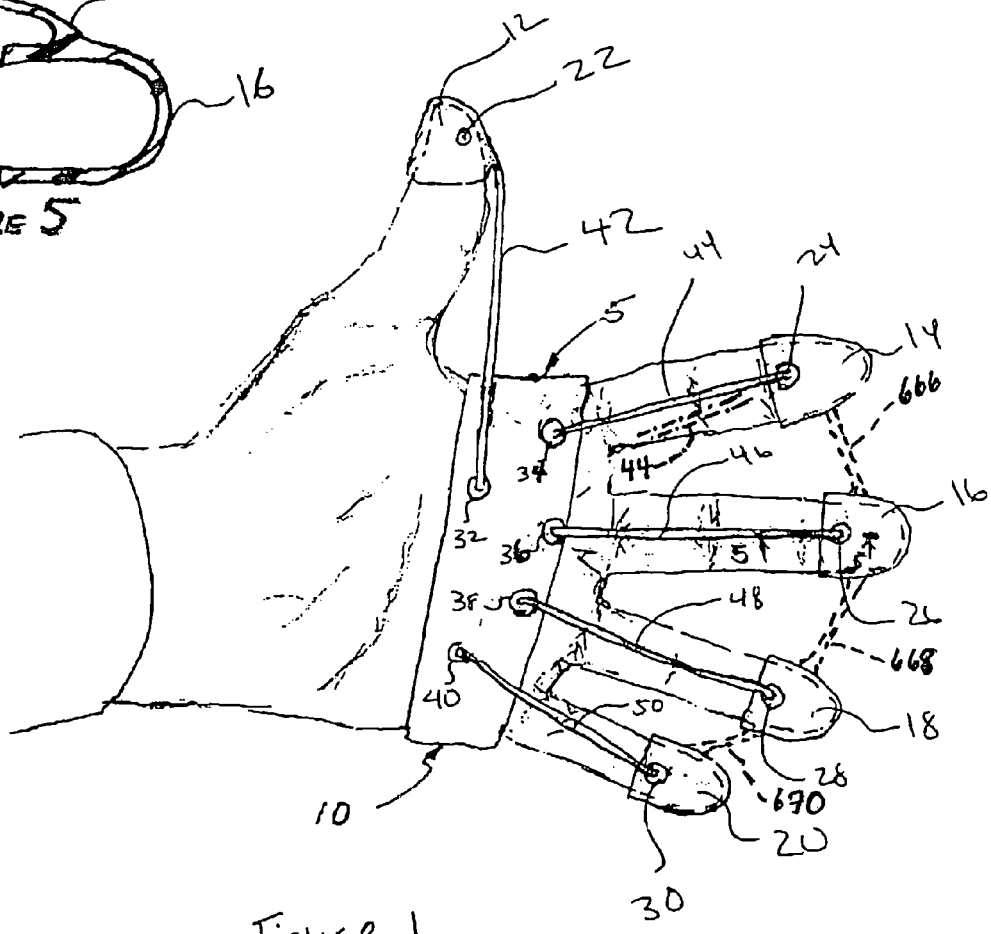
FIG. 1 is a view from the top illustrating the invention on the hand of a user showing the position of the inventive exerciser against the palm of the user with the fingers extended against the force of the inventive device.
Figure 2:
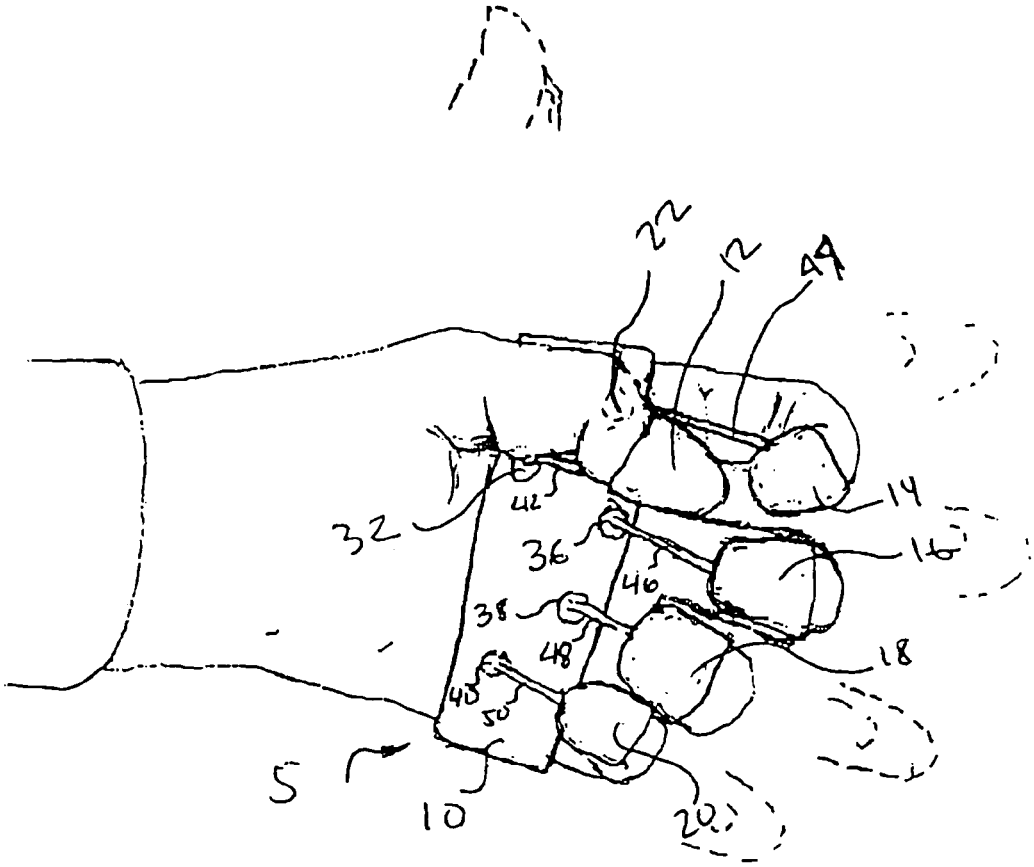
FIG. 2 illustrates the inventive device of FIG. 1 with the fingers in a substantially unextended position.

Referring to FIGS. 1 and 2, fingertip anchorings 22, 24, 26, 28, and 30 are secured to their respective palm anchorings 32, 34, 36, 38, and 40, respectively, by elastic members 42, 44, 46, 48, and 50, respectively. More particularly, each elastic member 42-50 has a first and a second end. The first end of each elastic member is secured to its fingertip anchoring. The second end of each elastic member is secured to its respective palm anchoring. In preferred embodiments elastic members 42, 44, 46, 48, and 50 are integral with anchoring member 10. Preferably, anchoring member 10, elastic members 42, 44, 46, 48, and 50, fingertip engaging cups 12-20 and anchoring member 10 are injection molded in one operation from an elastic moldable material similar to that used to manufacture rubber bands. Alternatively, member 10, elastic members 42, 44, 46, 48, and 50, fingertip engaging cups 12-20 may be manufactured in separate operations and hand exerciser 5 assembled using any known procedure which will result in structural integrity under the forces typically experienced during exercise of the hand. Elastic members 42, 44, 46, 48, and 50 may comprise elastic rubber or other appropriate synthetic or natural materials.

Elastic members 42, 44, 46, 48, and 50 are appropriately dimensioned to provide a desired range of force depending on the elasticity of the material of which elastic members 42, 44, 46, 48, and 50 are made and the dimensions of the elastic members. In preferred embodiments, elastic members 42, 44, 46, 48, and 50 are dimensioned to exert more force against the extension of the thumb and less force against the extension of the pinkie. Elastic members 42, 44, 46, 48, and 50 may or may not be permanently secured to fingertip anchorings, depending on the preference of the designer. In accordance with the invention, it is contemplated that structure may be provided to enable the user to adjust resistance levels on either elastic members or at attachment to anchoring member.

Figure 3:
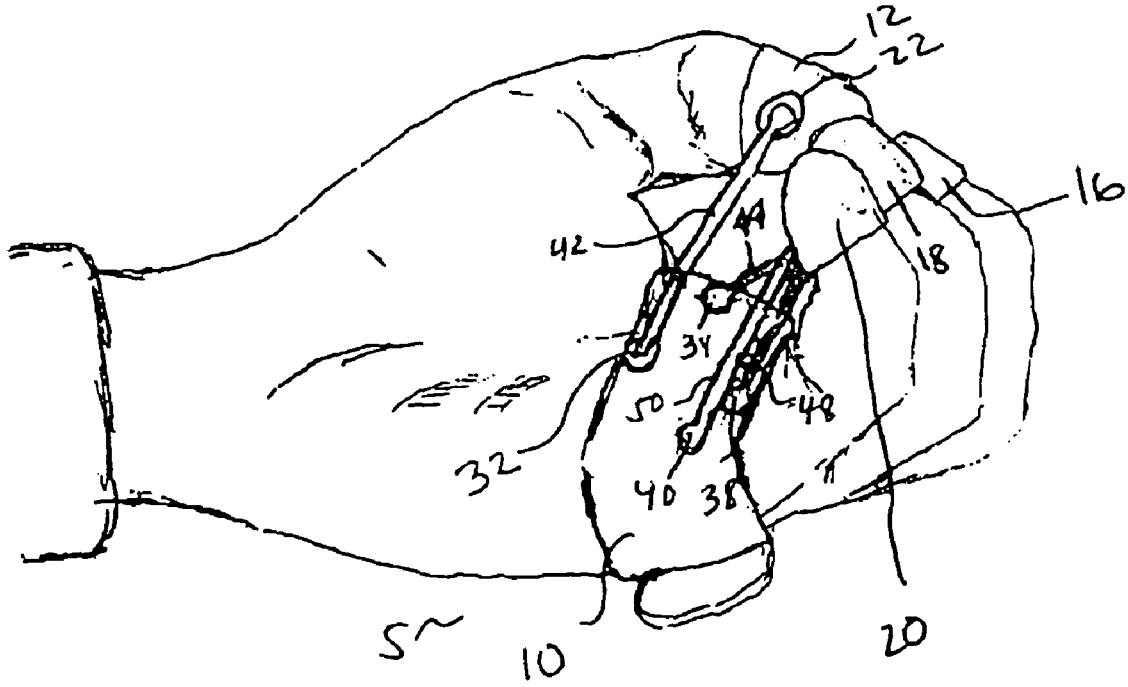
FIG. 3 is a side view of the invention as illustrated in FIGS. 1 and 2 to along lines 3-3 of FIG. 2.
Figure 4:
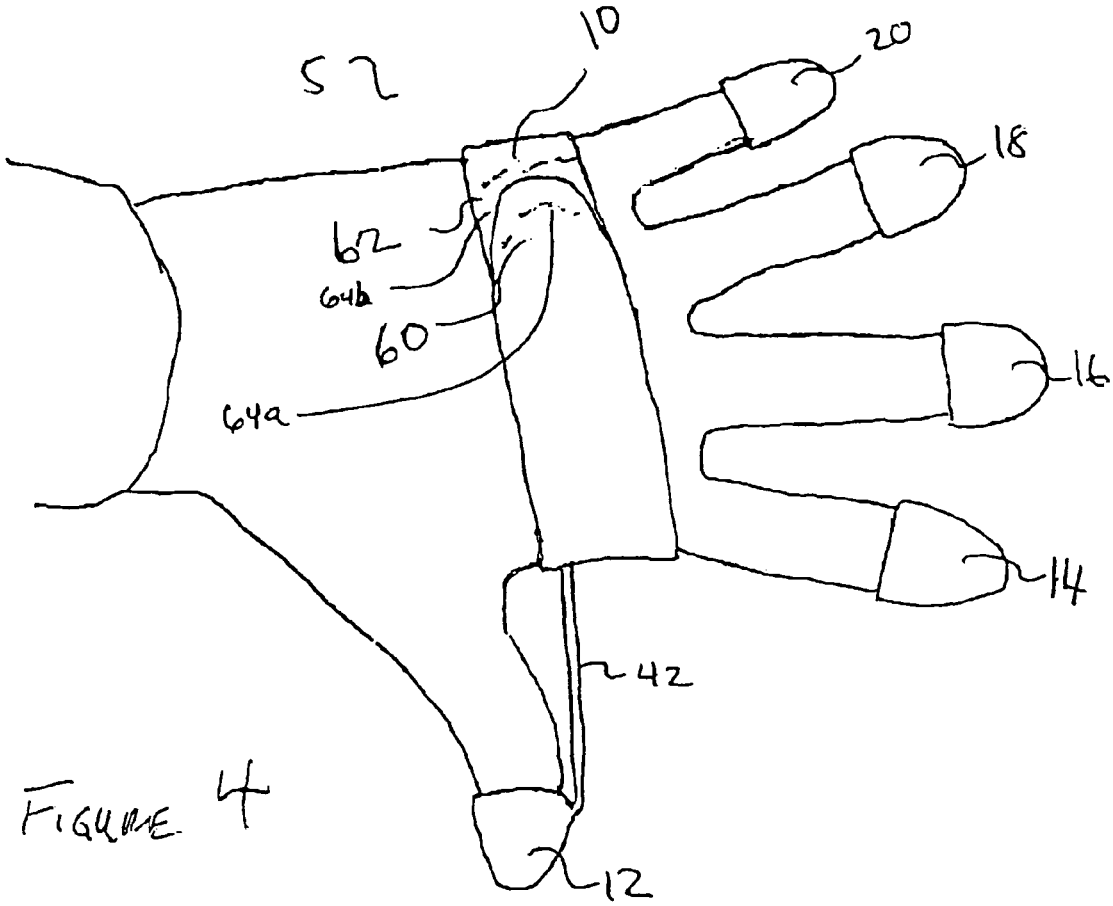
FIG. 4 is a view of the hand exerciser of the present invention as illustrated FIG. 1 from the bottom.

As shown in FIG. 4, anchoring member 10 is preferably configured and dimensioned to extend around the hand of the user and with a length large enough to allow the ends to lie over each other, providing enough length for a closure, such as a buckle or Velcro brand hook and loop attachment. As can be seen in FIGS. 3 and 4, the ends of anchoring member 10 form a pair of strap ends 60 and 62 which are oriented and dimensioned to extend around the hand. Straps 60 and 62 may be attached to each other, for example by mating Velcro hook material 64*a* and loop material 64*b*, each of which is secured to its respective strap 60 and 62. In addition to hook and loop type attachments, other suitable attachment devices include buckle, stud and hole, an eyelet hook system, and snaps. Anchoring member 10 may also comprise a one piece stretchable material, a metal coated with plastic or the like. It may be planar, or have a slope that conforms to the hand.

When it is desired to use the inventive exerciser 5, the user secures anchoring member 10 around the hand as illustrated in FIG. 1, with palm anchorings 32-40 positioned over the palm of the hand of the user. Placement of palm anchorings 32-40 over the palm has the advantage of providing for a substantially similar amounts of stretch in all of the elastic members 42-50, including elastic member 42 which is used to exercise the thumb, as will be understood from the description below.

Anchoring member 10 is then secured in place by placing strap end 60 over strap end 62, tightly securing anchoring member 10 around the hand, as illustrated in FIG. 4. This results in mating attachment between hooks in material 64*a* and loops in material 64*b*. The result is that anchoring member 10 is securely fastened around the hand of the user in the fashion of a belt.

Flexible fingertip cups 12-20 are then positioned over the tip of their respective fingers, as illustrated in FIG. 1. This is done while the hand is in the almost closed position. At this point, the user may begin to exercise the hand. During exercise the hand is cycled between the position illustrated in FIG. 2, where elastic members 42-50 are not under tension to the position shown in FIG. 1. As can be seen from FIG. 2, elastic members 42-50 are of substantially equal length in the compressed position. When the hand is extended, as illustrated in phantom lines in FIG. 2, elastic members 42-50 are subjected to similar extension in accordance with the preferred embodiment. Thus, all of the elastic members 42-50 exert substantial force on the fingers of the hand of the user or when the exerciser 5 is in the extended position shown in FIGS. 1 and 4.

When it is desired to exercise, the hand is first put in the position illustrated in FIGS. 2 and 3. The user that extends all the fingers simultaneously into the outstretched position illustrated in FIG. 1. If desired, the user may increase the value of the exercise by maintaining the hand in the outstretched position illustrated in FIG. 1.

After the hand is put in the outstretched position illustrated in FIG. 1, the fingertips are then slowly returned to the position illustrated in FIG. 3. Slow return from the FIG. 1 position to the FIG. 2 position improves the quality of the exercise, as the muscles are developed and strengthened at a plurality of positions.

Once the hand has been placed in the position of FIG. 3, the hands are slowly outstretched toward the position shown in phantom lines in FIG. 2. Here again, the slow outstretching of the fingers is important to develop strength over the full range of movement of the fingers in both the outstretching and the opposite grasping movement. It is noted that while outstretching the hand and holding that position, increased flexibility can be gained in the palm.

Figure 6:
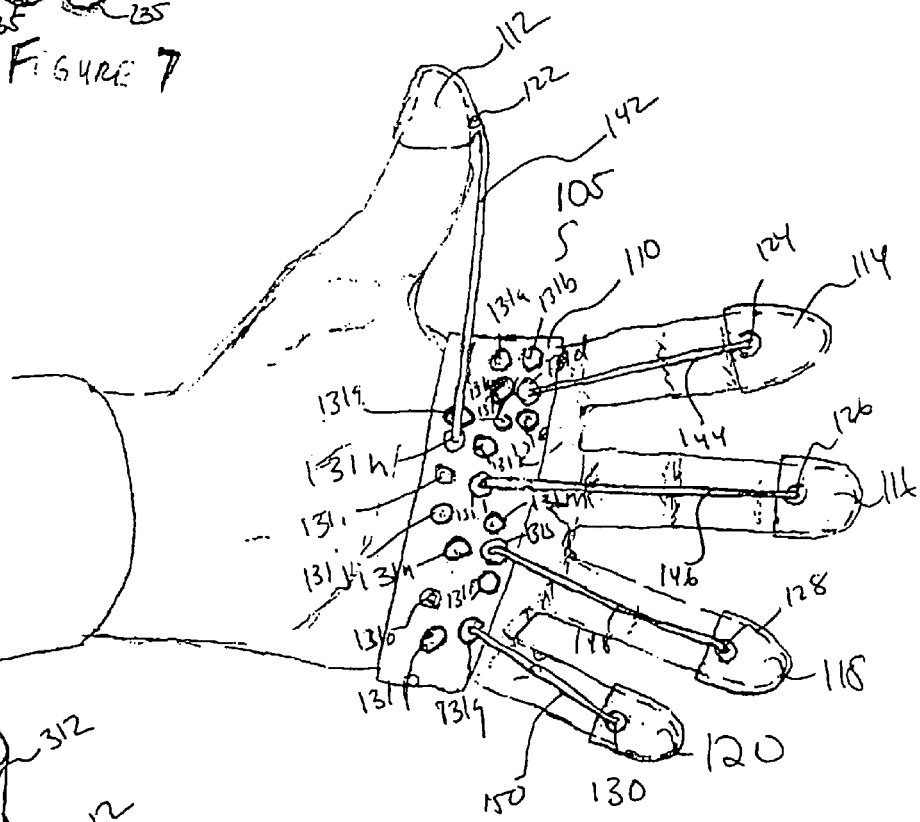
FIG. 6 is an alternative embodiment of the invention.

As shown in the alternative embodiment of FIG. 6, an alternative hand exerciser 105 comprises an anchoring member 110, thumb cup 112, forefinger cup 114, middle finger cup 116, ring finger cup 118, and pinkie cup 120. Anchoring member 110 overlies the palm of a user when the exercising device is being used. The fingertip anchorings 122, 124, 126, 128, and 130 are respectively provided for each end of the fingertip anchorings secured to their respective fingertip engaging member. In the embodiment shown, exerciser 105 includes multiple palm anchorings 131*a*, 131*b*, 131*c*, 131*d*, 131*e*, 131*f*, 131*g*, . . . 131*s* (collectively referred to as "anchorings 131"). Anchorings 131 are disposed throughout the area of anchoring member 110. Palm anchorings 131 are removably connected to any one of the elastic members 142, 144, 146, 148, and 150, in order to provide customization of the amount of force and direction of force experienced by the hand during exercise. Elastic member 142-150 may be selected for any desired force range.

The provision of a plurality of anchorings 131 allows one to ensure that the primary exercise being implemented is balanced. In accordance with the preferred embodiments, it is contemplated that the primary muscles to be exercised are best exercised when the elastic members line up with the finger. Such a condition is illustrated in FIG. 1, where elastic band 44 lines up with the index finger. However, particularly if one exercising device is used to accommodate a wide variety of hand sizes and shapes, it is possible that fixed palm anchorings may result in a situation such as that illustrated in phantom lines in FIG. 1 where the elastic member 44 is canted to the side. The provision of a plurality of anchorings 131 in the embodiment of FIG. 6 ensures the ability to place an anchoring in the position which will result in the outstretched finger of the person doing the exercise being substantially parallel in orientation to the tensioned elastic member, as illustrated in solid lines in FIGS. 1 and 6. The plurality of anchorings also enable the user to increase or decrease resistance in an individual finger.

Figure 7:
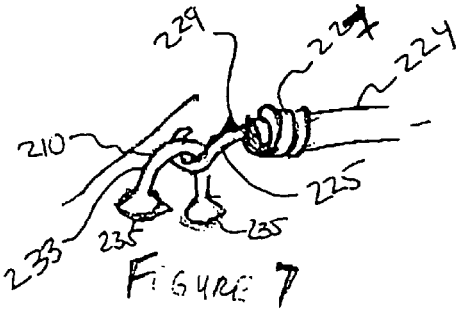
FIG. 7 illustrates an alternative anchoring particularly useful for the alternative embodiment illustrated in FIG. 6.

In accordance with the invention, any one of a number of prior art attachment devices may be used to connect the elastic members to the fingertip cups and to the palm anchorings. FIG. 7 illustrates one of a number of possible anchoring mechanisms particularly useful for the alternative embodiment illustrated in FIG. 6. More particularly, and in accordance with an alternative embodiment of the invention, a number of elastic cords 224 are provided. Elastic cords 224 connect to hooks 225. Each hook 225 includes a coiled portion 227, which is tightly wound around the end of elastic cord 224. An integral hook portion 229 is formed from the same metal wire or bar stock that forms coiled portion 227. Hook 224 may be made of stainless steel or other suitable material with the requisite strength and sufficient non-reactivity when in close contact with the skin of the exercise device user.

Hook portion 229 mates with loop members 233 which are secured to anchoring member 210 through the use of a plurality of frustro conical support bases 235. Frustro conical support bases 235 are embedded in anchoring member 210. In accordance with the preferred embodiment, anchoring member 210 may be made of a flexible plastic material and may be injection molded. Prior to injection molding of the anchoring member 210, loop members 233 are placed in the mold with the frustro conical support bases 235 extending into the cavity of the mold. Suitable resin is then injected into the mold, surrounding frustro conical support bases 235 and forming anchoring member 210. The result is to form an anchoring member 210 with securely fastened loop members 233. Alternative support bases may comprise T-shaped terminations, or any suitably sized and shaped termination which results in securely anchoring loop members 233 in anchoring member 210.

Figure 8:
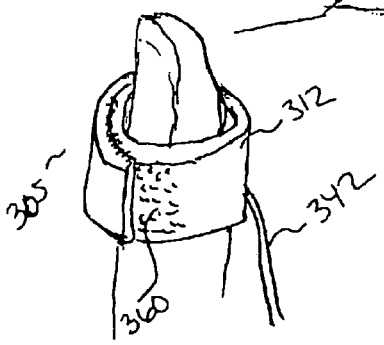
FIG. 8 is an alternative embodiment of the invention showing an alternative embodiment of the fingertip engaging members.

As shown in FIG. 8, an alternative fingertip engaging member, suitable for use in any of the disclosed inventive exercising devices, takes the form of strips of fabric or similar material which may be formed into loops, as illustrated. FIG. 8 shows a fingertip engaging member for a thumb comprising strip 312. Strip 312 comprises a flexible material such as fabric. The ends of the loops may be secured through eyelet hook or other fastening system. In a preferred embodiment, the size of loop 312 is adjustably secured around the fingertip of a user through the use of a Velcro (™) hook and loop securement system. Material bearing hooks 360 is secured to one of the ends of strip 312. The other end of strip 312 has Velcro type loop material 362. The use of Velcro provides for a customizable fit.

Figure 9:
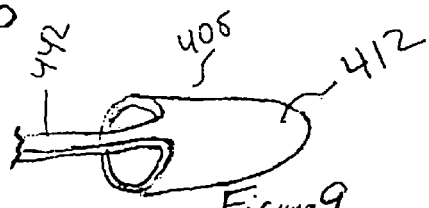
FIG. 9 is an alternative embodiment of the invention showing another alternative embodiment of the fingertip engaging members.

Still another alternative fingertip engaging member 412 is shown in FIG. 9. The fingertip engaging member 412 takes the form of a cup similar to the cups which are used to engage the fingertip in the FIG. 1 embodiment. The difference is that elastic member 442 extends from the peripheral edge at the opening of cup 412. Otherwise, the structure and operation of the device incorporating engaging member 412 of FIG. 9 is similar to the exercising device 5 of the embodiment shown in FIGS. 1-5.

Figure 10:
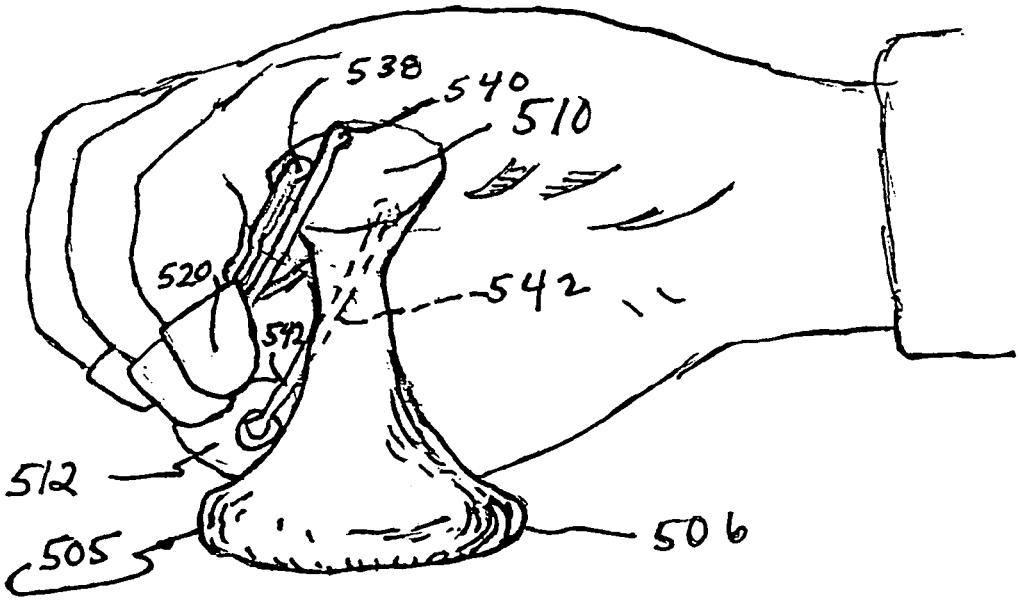
FIG. 10 illustrates a desk mounted version of the inventive device in use.
Figure 11:
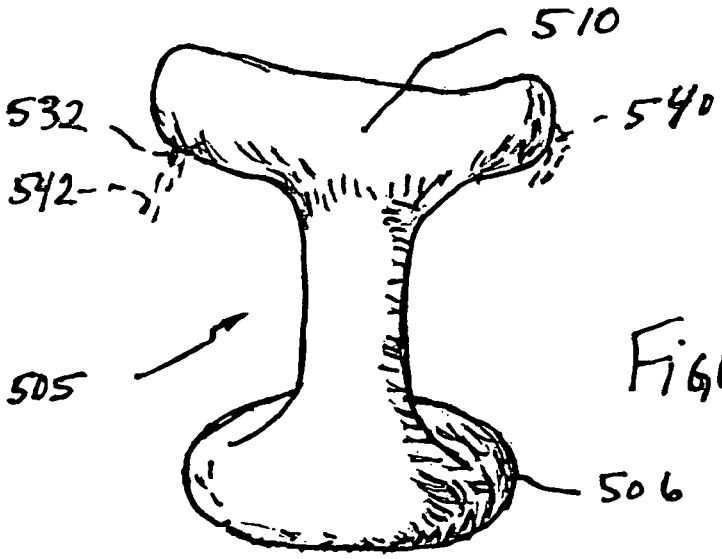
FIG. 11 illustrates the alternative embodiment of the invention shown in FIG. 10 with the elastic members and finger cups removed for purposes of clarity of illustration of the base and palm rest.

As illustrated in FIGS. 10 and 11, a desk mounted exercise device 505 may include a base 506 which is integral with a T-shaped anchor 510. Anchor 510 supports the hand of the user. Exercise device 505 has parts analogous to the exercise device 5 of the FIG. 1 embodiment, only some of which are numbered for purposes of clarity of illustration and succinctness of description. Exercise device 505 comprises fingertip cups 512 and 520, anchorings 538 and 540, and elastic members such as elastic member 542. Exercise device 505 is used in the same manner as hand exerciser 5, except that the hand is inserted during exercise, as illustrated.

During the movement of the hand from the position illustrated in, for example, FIG. 2 to the position illustrated in FIG. 1, it is noted that the fingers of the hand extend sideways, from positions where they are substantially parallel to each other, as illustrated in FIG. 2, to positions where they radiate from a central area in directions which are at an angle with respect to each other and separated from each other. In accordance with an alternative embodiment of the invention, a mild elastic resistance is provided by the alternative exerciser through the use of a plurality of elastic bands 666, 668 and 670, which extend between the index finger and the middle finger, the middle finger and the ring finger, and the ring finger and the pinkie, respectively, as illustrated in dashed lines in FIG. 1. The stretching of elastic bands 666, 668 and 670 requires much less force than the stretching of the other elastic bands, as only mild resistance is needed to achieve the desired development of the muscles. Thus, in accordance with this embodiment, the alternative exerciser includes all of the structure of the FIG. 1 embodiment together with the additional elastic bands 666, 668 and 670.

Referring to FIGS. 12-19, the inventive hand exerciser 705 comprises a palm anchor member 710 which cooperates with a Velcro belt 742. The hand mounting structure for securing exerciser 705 to the hand of the user further comprises a back anchoring member 799. Belt 742 passes through holes 743 on back anchoring member 799, as shown most clearly in FIGS. 12 and 20. Belt 742 also passes through holes 745 on palm anchor member 710, as illustrated most clearly in FIGS. 12 and 14. Belt 742 may be looped through holes 743*a* at one end and permanently sewn in position. The other end of belt 742 may carry a male Velcro (trademark) hook and loop member 747 which mates with female Velcro hook and loop material on the backside 749 of belt 742. This allows the other end of belt 742 to be looped through its respective hole 743, adjusted to be tightly secured around the base of the hand or the wrist of the user and locked in position by engagement of the male Velcro hook and loop with the female Velcro hook and loop.

In accordance with the preferred embodiment, hand exercisers are provided in a number of discrete sizes, such as a size dimensioned an average 22-year-old male.

In preferred embodiments, anchoring member 799 is a substantially planar member made of a flexible material and having arms 801 long enough to extend around the palm and back of the hand of the user with enough extra lengths to allow use of a suitable fastener. Suitable materials for anchoring member 799 may include any strong flexible material such as plastic or textile fabric, preferably of relatively thick dimension and not necessarily flat or one-dimensional. Arms 801 or secured in position against anchor member 710 by support member 760 which bears against arms 801. In addition, screws 731*a* and 731*d* pass through holes 803 and screw into member 710 to secure the structure. The structure is further secured by holes 731*b* and 731*c*.

Engagement of the fingertips 805 of the hand and the tip 807 of the thumb with hand exerciser 705 is achieved through the use of five fingertip engaging members and one of a pair of thumb-engaging members. A pair of thumb-engaging members 732*r* and 732*l* are provided to enable use of the exercising device with either the right or the left-hand, respectively. In accordance with the preferred embodiment, the fingertip engaging members take the form of a plurality of flexible conical fingertip anchor rings 732, 714, 716, 718, and 720, made of rubber, plastic or similar material, preferably a rubbery synthetic material. Thumb ring 732 is of relatively large dimension to accommodate the thumb. In accordance with the preferred embodiment, thumb ring 732 may be made slightly larger than the thumb of the hand of the size for which the hand exerciser 705 is designed. This allows it to be easily positioned over the tip of the finger in preparation for exercise as detailed below.

Thumb rings 732 must also be relatively strong because proper exercising of the thumb requires more force than, for example, proper exercising of the pinky or little finger. Accordingly, thumb ring 732 is subjected to greater forces and must be dimensioned to remain durable under constant forces of the magnitude needed to properly exercise the thumb. Thumb rings 732 are manufactured in a single injection molding process from a rubbery material which forms both thumb rings 732 and the elastic band 732*a* between them in one operation.

Finger rings 714 and 720 in accordance with the preferred embodiment, are smaller in circumference than thumb ring 732. However, rings 714, 716, 718, and 720 may all be the same dimension, or a limited number of dimensions, which will reduce costs in the case of an exercising device constructed in accordance with the present invention made from separately molded conical fingertip anchor rings connected by elastic members, as will be described more fully below. In accordance with the preferred embodiment, elastic members 714*b*-720*b* are integral with their respective finger rings 714-720 and their respective anchor side connectors 718*a* through 720*a*. Similarly, from engaging rings 732 are integral with elastic band 732*a*.

The conical fingertip anchor rings 716 and 718, designed for the middle and ring fingers may be of somewhat smaller dimension, in accordance with the preferred embodiment, as compared to conical thumb ring 732. However, pinky or index finger (depending upon whether a right or left hand is being exercised by the inventive exerciser) rings 720 and 714, which fit around the pinky or index fingertip are of still smaller dimension because the pinky or index fingers are the smallest fingers on the hand.

Each of the rings 714, 716, 718, and 720 are, in accordance with the preferred embodiment, formed integrally with a respective one of elongated elastic members 714*b*, 716*b*, 718*b*, and 720*b* and elastically tethered by tension anchors 714*a*, 716*a*, 718*a*, and 720*a*. On the opposite side of the elongated elastic bands 714*b*, 716*b*, 718*b*, and 720*b* are tension anchors 714*a*, 716*a*, 718*a*, and 720*a*.

Tension anchors 714*a*, 716*a*, 718*a*, and 720*a* are engaged by, for example, fingers 734*a-b*, being adjacent the selected one of the twelve palm anchoring holes 734, 734', 734", 736, 736', 736", 738, 738', 738", 740, 740', and 740 found on palm anchor 710. Palm anchor 710 provides twelve such anchoring holes 734, 734', 734", 736, 736', 736", 738, 738', 738", 740, 740', and 740 which mate with tension anchors 714*a*, 716*a*, 718*a*, and 720*a* for the purposes of user selected tension control. Palm anchoring holes 734, 734', 734", 736, 736', 736", 738, 738', 738", 740, 740', and 740" have associated with them fingers 734*a-b*; 734'*a-b*; 734"*a-b*; 736*a-b*; 736'*a-b*; 736"*a-b*; 738*a-b*; 738'*a-b*; 738"*a-b*; 740*a-b*; 740'*a-b*; and 740"*a-b*, respectively. These fingers are used to secure tension anchors 714*a*, 716*a*, 718*a*, and 720*a* at user selectable positions on anchoring member 710. Anchors 714*a*, 716*a*, 718*a*, and 720*a* are secured adjacent that one of the twelve anchor holes 734, 734', 734", 736, 736', 736", 738, 738', 738", 740, 740', and 740" via the fingers, a pair of which fingers are affixed adjacent the top of each of the twelve anchoring holes.

Figure 12:
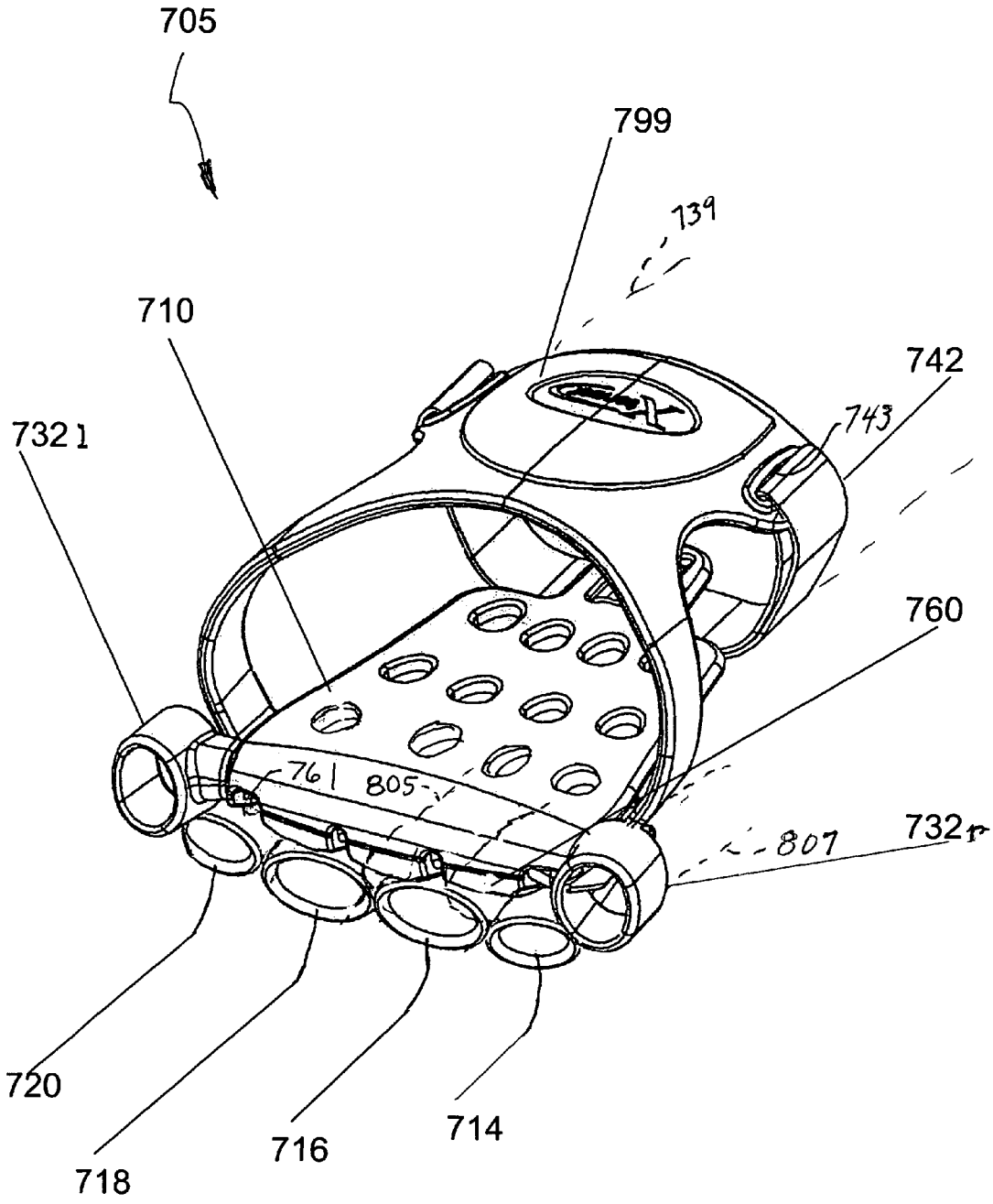
FIG. 12 is a perspective view from the top illustrating an alternative embodiment of the invention with the parts in the position which they are in before they are about to be used.
Figure 13:
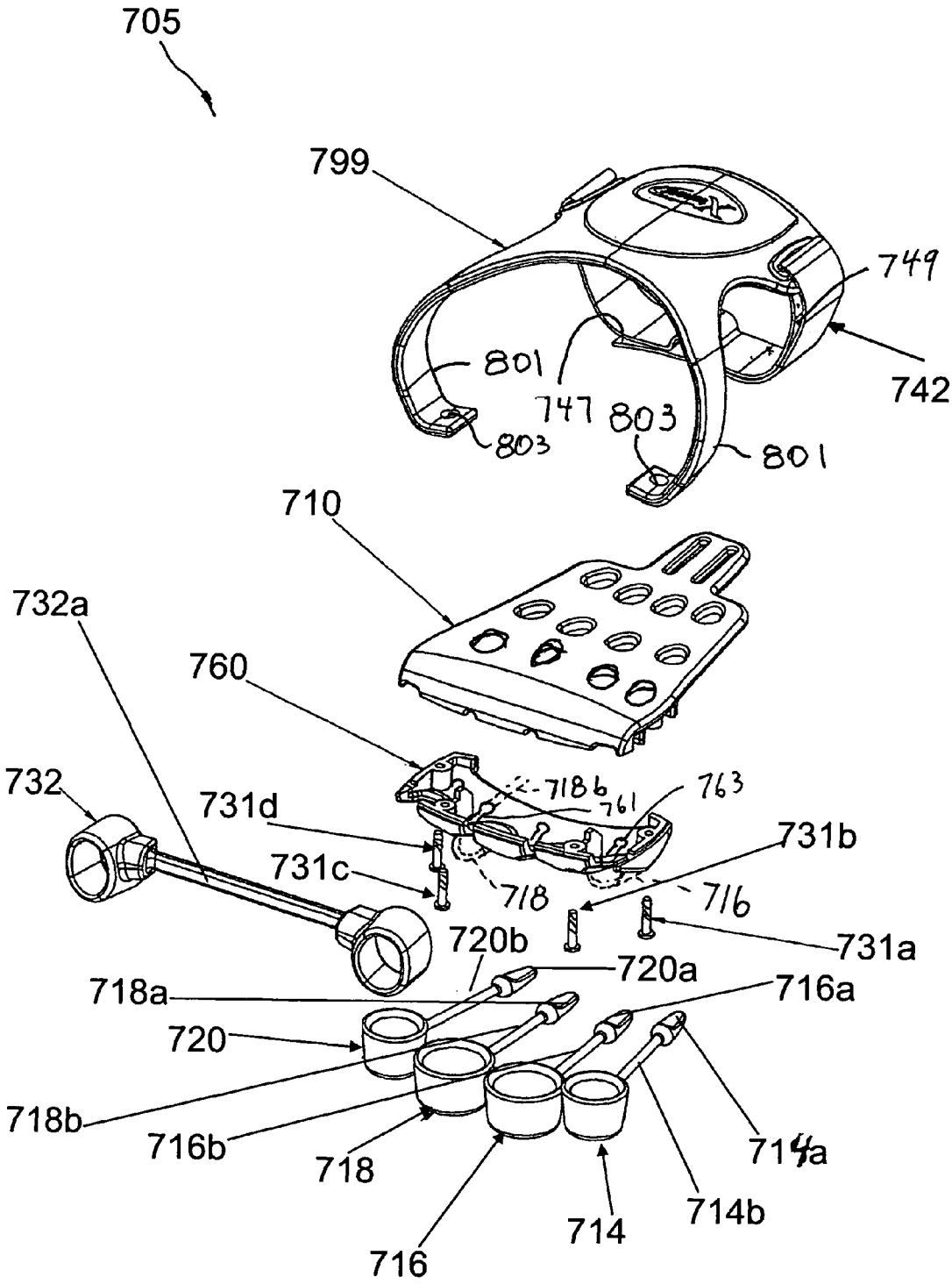
FIG. 13 is an exploded perspective view of the hand exercising device illustrated in FIG. 12 showing the parts in the configuration in which they are molded during manufacture of the inventive exercising device and before they are bent or deflected by assembly of the inventive hand exercising device.
Figure 14:
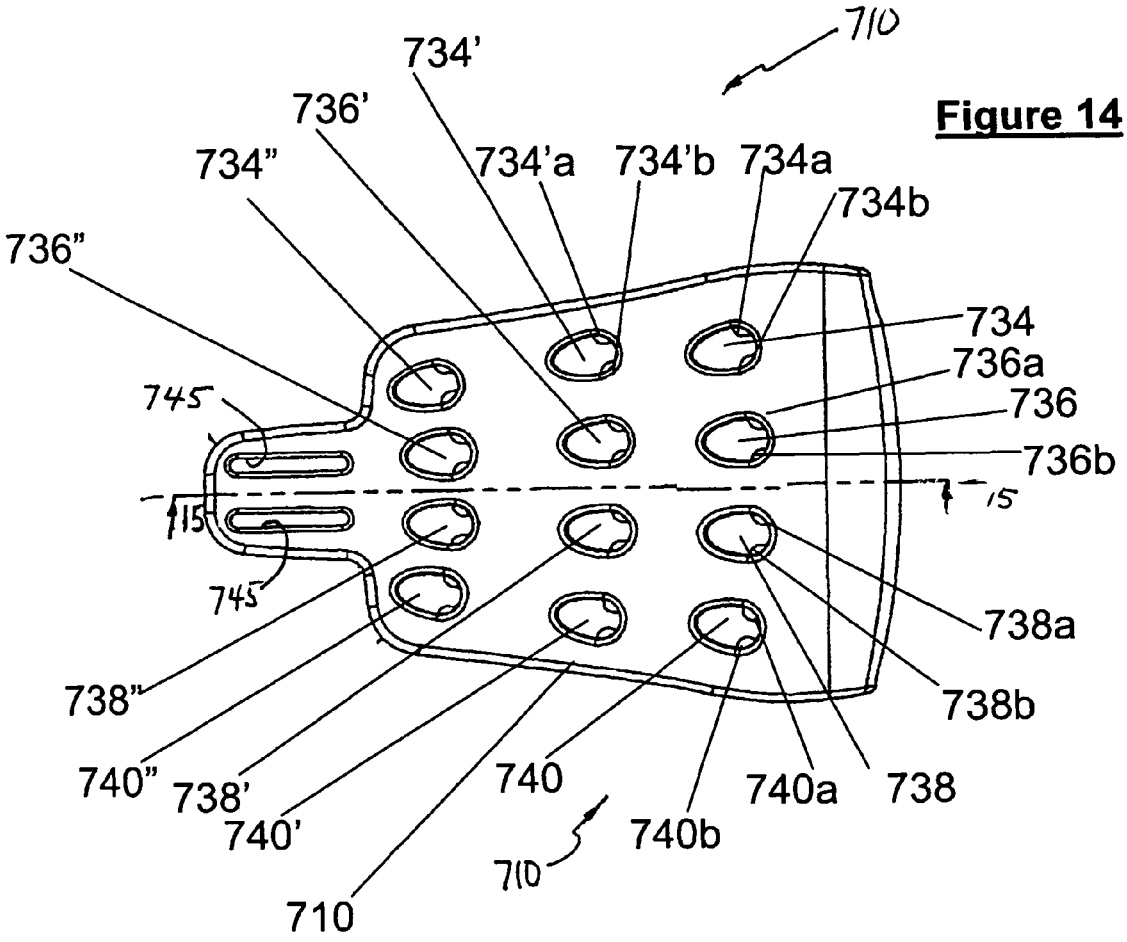
FIG. 14 is a top plan view of the palm anchoring plate for the hand exercising device illustrated in FIG. 12.
Figure 15:
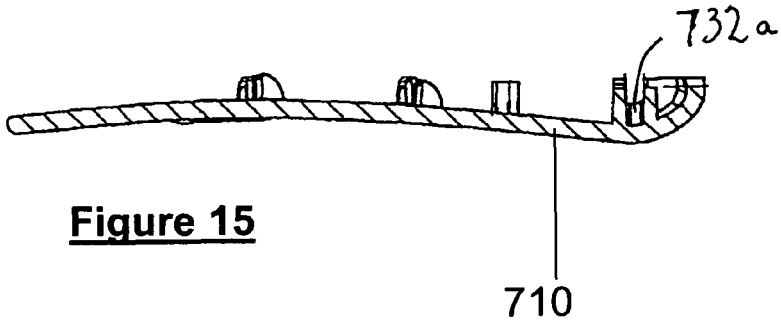
FIG. 15 is a cross-sectional view of the plate of FIG. 14 along lines 15-15 of FIG. 14.
Figure 16:
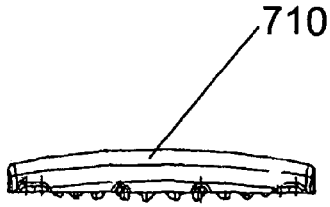
FIG. 16 is a front plan view of the plate of FIG. 14.
Figure 17:
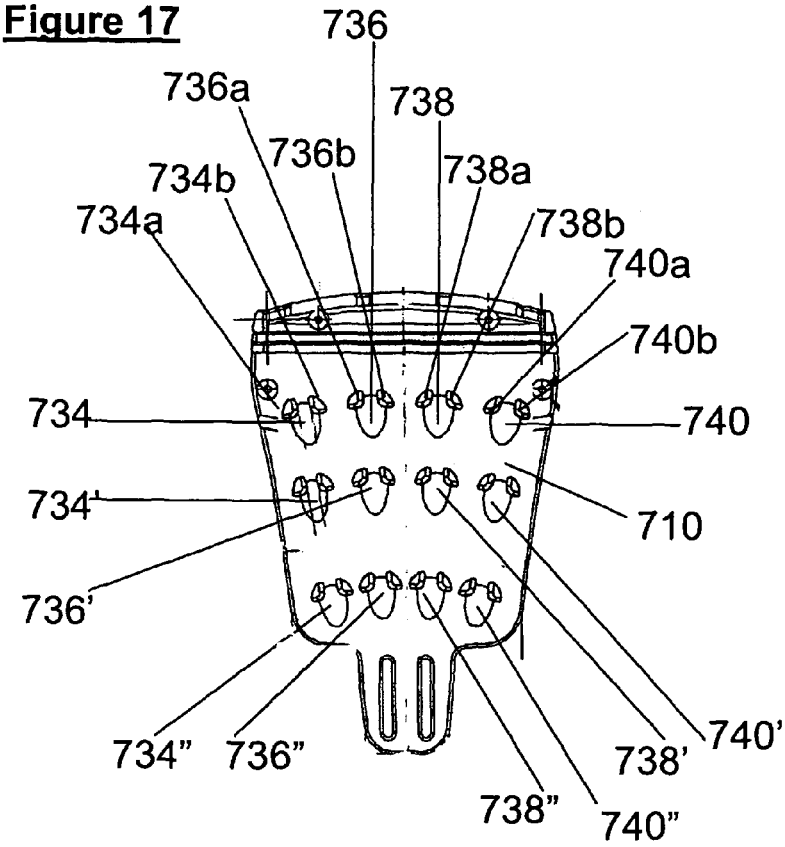
FIG. 17 is a top plan view of the plate of FIG. 14.
Figure 18:
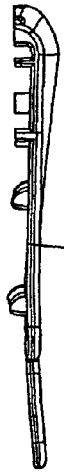
FIG. 18 is a side elevational view of the plate of FIG. 14.
Figure 19:
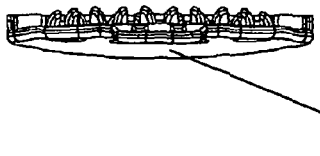
FIG. 19 is a rear view of the plate of FIG. 14.

Referring to FIGS. 12 and 13, conical fingertip anchor rings 714, 716, 718, and 720 are secured to their respective palm anchorings 734, 734', 734", 736, 736', 736", 738, 738', 738", 740, 740', and 740", respectively, by elastic members 732*a*, 714*b*, 716*b*, 718*b*, and 720*b*, respectively. The thumb conical fingertip anchor rings are secured together by elastic member 732*a*. More particularly, each elastic member 714, 716, 718, and 720 has a first and a second end. The first end of each elastic member is secured to and preferably integral with its conical fingertip anchor ring. The second end of each elastic member is secured to and preferably integral with its respective palm anchoring, which depends on the desired tension setting.

Skeletal member 759 and back anchoring member 799 are molded in two operations. First skeletal member 759 is manufactured and then back anchoring member 799 is, for example, injection molded around skeletal member 759. Skeletal member 759 may be marked with a self-adhesive urethane decal to display a trademark. Anchoring member 799 may be made from an elastic moldable material similar to that used to manufacture rubbery products. In contrast, skeletal member 759 is molded from a significantly harder material. Similarly, palm anchor member 710 is also made from a relatively stiff and resilient material which offers wrist and palm support during the exercise.

While the parts are manufactured in separate operations, hand exerciser 705 may be assembled using any known procedure which will result in structural integrity under the forces typically experienced during exercise of the hand. Elastic members 732*a*, 714*b*, 716*b*, 718*b*, and 720*b* may comprise elastic rubber or other appropriate synthetic or natural materials.

Elastic members 732*a*, 714*b*, 716*b*, 718*b*, and 720*b* test between palm anchoring member 710 and support members 760 which has a plurality of tracks 761 and holes 763 through which elastic members 732*a*, 714*b*, 716*b*, 718*b*, and 720*b* pass, preferably under tension, thus serving as mountings for conical fingertip anchoring 714-720 as illustrated in FIG. 12.

Elastic members 732*a*, 714*b*, 716*b*, 718*b*, and 720*b* are appropriately dimensioned to provide a desired range of force depending on the elasticity of the material of which elastic members 732*a*, 714*b*, 716*b*, 718*b*, and 720*b* are made and the dimensions of the elastic members. In preferred embodiments, elastic 732, 714*b*, 716*b*, 718*b*, and 720*b* are dimensioned to exert more force against the extension of the thumb and less force against the extension of the pinky or little finger. Elastic members 732*a*, 714*b*, 716*b*, 718*b*, and 720*b* may or may not be permanently secured to conical fingertip anchor rings, depending on the preference of the designer.

Figure 20:
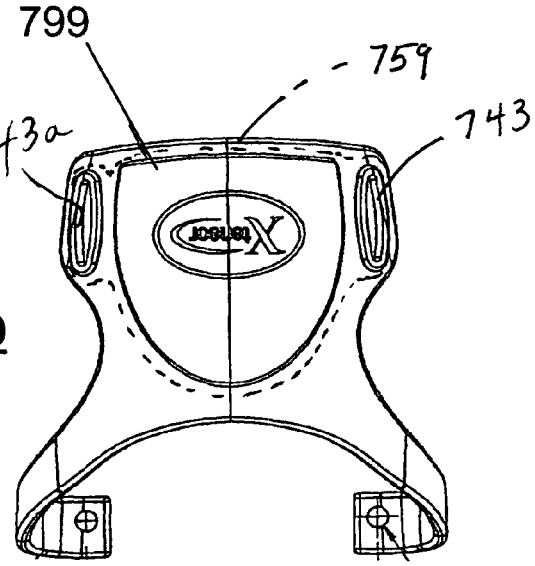
FIG. 20 is a top plan view of the back anchor in the inventive hand exercising device.
Figure 21:
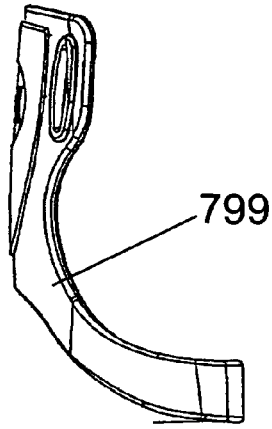
FIG. 21 is a front plan view of the back anchor of the inventive hand exercising device.
Figure 22:
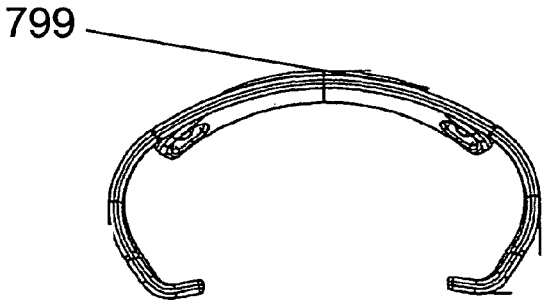
FIG. 22 is a side elevational view of the back anchor in the inventive hand exercising device.

As shown in FIG. 20, anchoring member 742 is preferably configured and dimensioned to extend around the hand of the user. Strap 742 may be fastened, for example by mating Velcro hook material and loop material on the ends and middle of the strap or which is secure to the strap via stitching. In addition to hook and loop type attachments, other suitable attachment devices include buckle, stud and hole, an eyelet hook system, and snaps.

Alternatively, and 742, which secures device 705 to the hand at the wrist of the user has a length large enough to allow the ends to lie over each other, providing enough length for a closure, such as a buckle or Velcro brand hook and loop attachment. In an alternative embodiment, Anchoring member 799 may also comprise a one piece stretchable material, a metal coated with plastic or the like. It may be planar, or have a slope that conforms to the hand. As can be seen in FIG. 20, the ends of anchoring member 742 connect back anchoring member 799 to palm anchoring member 710 and also hold the elongated belt 742 in place.

When it is desired to use the inventive exerciser 705, the user secures belt 742 around the wrist 739 as illustrated in FIG. 12, with palm anchorings 734, 734', 734", 736, 736', 736", 738, 738', 738", 740, 740', and 740" positioned over the palm of the hand of the user. Placement of palm anchorings 734, 734', 734", 736, 736', 736", 738, 738', 738", 740, 740', and 740" over the palm has the advantage of providing for substantially similar, or selectively different, or proportionate amounts of stretch in all of the elastic members 732*a*, 714*b*, 716*b*, 718*b*, and 720*b*, including elastic member 732 which is used to exercise the thumb, as will be understood from the description below.

Anchoring member 710 is then secured in place by placing tightening strap 742 (as configured passing through holes 743 and 745) around the hand, as illustrated in FIG. 12. This results in mating attachment between hooks stitched on strap 742 to the loops also on strap 742. The result is that the inventive exerciser 705 is securely fastened to the hand of the user.

Flexible conical fingertip anchor rings 732, 714, 716, 718, and 720 are then positioned over the tip of their respective fingers, as illustrated in FIG. 12.

This is done while the hand is in the almost closed position. At this point, the user may begin to exercise the hand. During exercise the hand is cycled between the position where elastic members 732, 714, 716, 718, and 720 are not under substantial tension to a position substantially the same as that shown in FIG. 1. When the hand is extended, as illustrated in phantom lines in elastic members 732*a*, 714*b*, 716*b*, 718*b*, and 720*b* are subjected to similar extension in accordance with the preferred embodiment. Thus, all of the elastic members 732*a*, 71*b*, 71*b*, 71*b*, and 72*b* exert adjustable and potentially substantial force on the fingers of the hand of the user or when the exerciser 705 is in the extended position.

When it is desired to exercise, the hand is first put in a position similar to that illustrated in FIGS. 2 and 3. The user then extends one or more of his fingers simultaneously into the outstretched position substantially as illustrated in FIG. 1-2. If desired, the user may increase the value of the exercise by maintaining the hand in the outstretched position illustrated in FIG. 1 or by changing the tension of the elongated members by affixing their anchor side connectors marked 732*a*, 714*b*, 716*b*, 718*b*, and 720*b* to anchor holes 734', 734", 736', 736", 738', 738", 740', and 740" closer to the wrist.

After the hand is put in the outstretched position illustrated in FIG. 1, the fingertips are then slowly returned to a position substantially as illustrated in FIG. 3. Slow return from the FIG. 1 position to the FIG. 2 position improves the quality of the exercise, as the muscles are developed and strengthened at a plurality of positions.

While some illustrative embodiments of the invention have been described above, it is, of course, understood that various modifications will be apparent to those of ordinary skill in the art. For example, skeletal member 759 has a recessed area that may house a urocal (urethane logo decal) which could be also printed instead. Such modifications are within the spirit and scope of the invention, which is limited and defined only by the appended claims.

The invention claimed is:

1. A method of exercising the human hand comprising:

securing a support over the palm of the hand of a user;

engaging a plurality of fingertip engaging members over a plurality of respective fingertips of the hand of the user;

each of the fingertip engaging members being secured to one of a plurality of elastic cords at elastic cord first ends;

the other ends of the elastic cords being secured to respective base anchorings, at least one of said elastic cords being secured to a fingertip engaging member disposed around the tip of the thumb of the hand being exercised, the tip of said thumb following a path substantially in line with the outstretched thumb, when the tip of the thumb of a user is moved from a first position which said thumb has when the fingers are retracted and the tip of the thumb is over the palm to the position which said thumb has when the fingers of the hand are extended and said elastic cord associated with said thumb is stretched.

2. A method of exercising the human hand comprising:

securing a support over the palm of the hand of a user;

engaging a plurality of fingertip engaging members over a plurality of respective fingertips of the hand of the user;

securing each of the fingertip engaging members to one of a plurality of elastic cords at elastic cord first ends;

securing the other ends of the elastic cords to respective base anchorings, a first one of said elastic cords at its first end being associated with said thumb and being secured to a fingertip engaging member disposed around the tip of the thumb of the hand being exercised, the other end of said first elastic cord being secured to a base anchoring located on said support and over the palm of the hand of the user, exercising the hand by moving the tip of said thumb along a path extending roughly in the same direction as the direction of the outstretching of the thumb, when the tip of the thumb of a user is moved in a movement from a first position which said thumb and the fingers are retracted inward and over a palm and in which the tip of the thumb is over the palm to a position where said thumb and the fingers of the hand are extended outwardly, and stretching said elastic cord associated with said thumb during said movement.

* * * * *